US005582031A

United States Patent [19]

Rathbone

[11] Patent Number: 5,582,031

[45] Date of Patent: Dec. 10, 1996

[54] AIR SEPARATION

[75] Inventor: Thomas Rathbone, Farnham, England

[73] Assignee: The BOC Group plc, Windlesham, England

[21] Appl. No.: 504,940

[22] Filed: Jul. 20, 1995

[30] Foreign Application Priority Data

Jul. 25, 1994 [GB] United Kingdom ..... 9414938

[51] Int. Cl.[6] ..... F25J 3/00

[52] U.S. Cl. ..... 62/646; 62/653; 62/654; 62/924

[58] Field of Search ..... 62/646, 654, 924, 62/653

[56] References Cited

U.S. PATENT DOCUMENTS

| | | | |
|---|---|---|---|
| 4,533,375 | 8/1985 | Erickson . | |
| 4,575,388 | 3/1986 | Okada | 62/654 |
| 5,069,699 | 12/1991 | Agrawal . | |
| 5,233,838 | 8/1993 | Howard | 62/646 |
| 5,337,570 | 8/1994 | Prosser | 62/646 |
| 5,361,590 | 11/1994 | Rathbone | 62/646 |

*Primary Examiner*—Ronald C. Capossela
*Attorney, Agent, or Firm*—David M. Rosenblum; Larry R. Cassett

[57] ABSTRACT

Air is compressed in a compressor, cooled in a main heat exchanger, partially condensed in a reboiler-condenser, introduced into a higher pressure rectifier, and separated therein into nitrogen and oxygen-enriched liquid. Resulting nitrogen is condensed in further reboiler-condensers. One part of the condensate is used as reflux in the higher pressure rectifier and another part as reflux in a lower pressure rectifier. A stream of oxygen-enriched liquid is withdrawn from the high pressure rectifier and sent to an intermediate pressure rectifier which is reboiled by one of the further reboiler-condensers and in which further nitrogen is separated. A stream of liquid further enriched in oxygen is withdrawn from the bottom of the intermediate pressure rectifier and is separated in the lower pressure rectifier and impure and pure oxygen products are withdrawn respectively therefrom. In addition an argon-enriched oxygen stream is withdrawn from the lower pressure rectifier through an outlet and separated in an argon rectifier. Further impure oxygen product is withdrawn from the bottom of the argon rectifier.

18 Claims, 1 Drawing Sheet

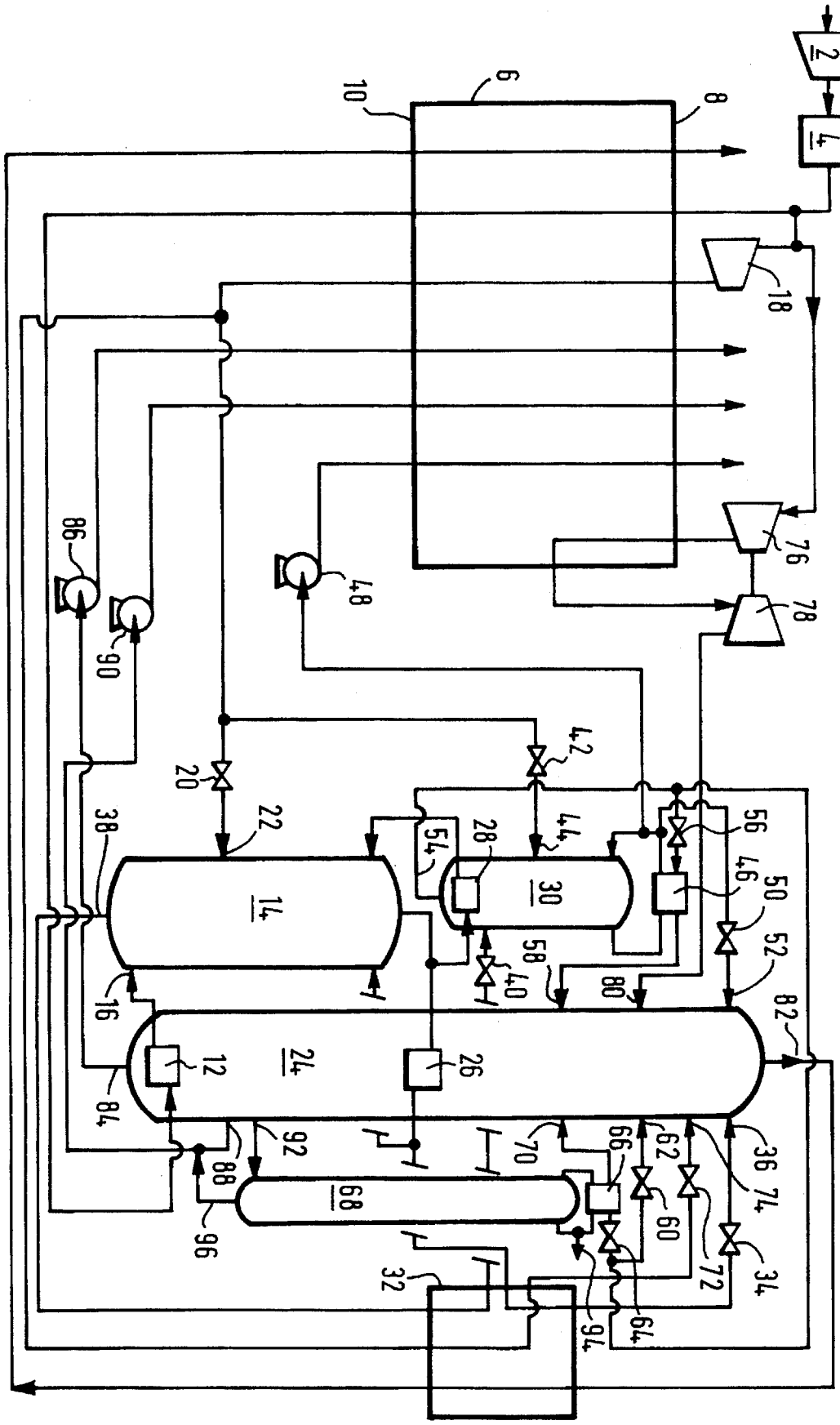
2
4
6
8
10
18
76
78
48
86
90
42
20
22
38
14
16
28
54
44
30
56
46
50
52
58
40
80
82
12
24
26
84
92
88
96
70
66
62
60
36
74
72
34
68
32
64
94

AIR SEPARATION

BACKGROUND OF THE INVENTION

This invention relates to a method and apparatus for separating air.

The most important method commercially of separating air is by rectification. The most frequently used air separation cycles include the steps of compressing a stream of air, purifying the resulting stream of compressed air by removing water vapor and carbon dioxide, and pre-cooling the stream of compressed air by heat exchange with returning product streams to a temperature suitable for its rectification. The rectification is performed in a so-called "double rectification column" comprising a higher pressure and a lower pressure rectification column i.e. one of the two columns operates at higher pressure than the other. Most if not all of the air is introduced into the higher pressure column and is separated into oxygen-enriched liquid air and liquid nitrogen vapor. The nitrogen vapor is condensed. A part of the condensate is used as liquid reflux in the higher pressure column. Oxygen-enriched liquid is withdrawn from the bottom of the higher pressure column, is sub-cooled, and is introduced into an intermediate region of the lower pressure column through a throttling or pressure reduction valve. The oxygen-enriched liquid is separated into substantially pure oxygen and nitrogen products in the lower pressure column. These products are withdrawn in the vapor state from the lower pressure column and form the returning streams against which the incoming air stream is heat exchanged. Liquid reflux for the lower pressure column is provided by taking the remainder of the condensate from the higher pressure column, sub-cooling it, and passing it into the top of the lower pressure column through a throttling or pressure reduction valve.

Conventionally, liquid oxygen at the bottom of the lower pressure column is used to meet the condensation duty at the top of the higher pressure column. Accordingly, nitrogen vapor from the top of higher pressure column is heat exchanged with liquid oxygen in the bottom of the lower pressure column. Sufficient liquid oxygen is able to be evaporated thereby to meet the requirements of the lower pressure column for reboil and to enable a good yield of pure gaseous oxygen product to be achieved.

An alternative to this conventional process is to use a part of the feed air to provide the necessary heat to reboil liquid in a first reboiler-condenser at the bottom of the low pressure column. This alternative removes the link between the top of the higher pressure column and the bottom of the lower pressure column. Accordingly, the operating pressure ratio between the two columns can be reduced, thus reducing the energy requirements of the air separation process. Nitrogen separated in the higher pressure column is condensed in a second reboiler-condenser by heat exchange with liquid withdrawn from an intermediate mass-exchange region of the lower pressure rectification column. This alternative kind of process is referred to as a "dual reboiler" process.

One disadvantage of dual reboiler processes is a difficulty in obtaining an argon product by rectification of an argon-enriched oxygen stream withdrawn from the lower pressure rectification column. In order to produce such an argon product effectively, it is desirable to operate the bottom section of the lower pressure rectification column at a relatively high reboil rate so as to achieve conditions therein close to minimum reflux. To achieve such a high reboil rate, air would need to be condensed in the first reboiler-condenser at a relatively high rate with an attendant high rate of condensation of the air. Introduction of such liquid air into the higher pressure column reduces the rate of formation of liquid nitrogen reflux available to the lower pressure column. As a result, attempts to achieve an adequate argon recovery by increasing the reboil rate beyond a certain limit would become self-defeating.

It is an aim of the present invention to provide a method and apparatus that ameliorate this problem.

SUMMARY OF THE INVENTION

According to the present invention there is provided a method of separating air, comprising the steps of compressing and cooling feed air; introducing a flow of the feed air at least partly in vapor state into a higher pressure rectifier and separating the flow into oxygen-enriched liquid air and nitrogen; condensing nitrogen so separated and employing one part of the condensate as reflux in the higher pressure rectifier and another part of it as reflux in a lower pressure rectifier; separating nitrogen-enriched vapor from a stream of the oxygen-enriched liquid air in an intermediate pressure rectifier; condensing nitrogen-enriched vapor so separated so as to provide reflux for the intermediate pressure rectifier; reboiling the intermediate pressure rectifier with a stream of nitrogen separated in the higher pressure rectifier and thereby condensing the nitrogen stream and meeting part of the requirement for condensation of the nitrogen separated in the higher pressure rectifier; separating in the lower pressure rectifier a stream withdrawn from the intermediate pressure rectifier of liquid air further enriched in oxygen; reboiling the lower pressure rectifier with a vapor stream of the feed air, and withdrawing a stream of argon-enriched oxygen vapor from the lower pressure rectifier and separating it by rectification to produce an argon product.

The invention also provides apparatus for separating air comprising means for compressing feed air and means for cooling the compressed air; a higher pressure rectifier for separating a flow of the-feed air at least partly in vapor state into oxygen-enriched liquid air and nitrogen; a plurality of first condensers for condensing nitrogen so separated so as to enable in use part of the condensed nitrogen to pass to the higher pressure rectifier as reflux and another part of it to a lower pressure rectifier also as reflux; an intermediate pressure rectifier for separating nitrogen-enriched fluid from a stream of oxygen-enriched liquid air withdrawn, in use, from the higher pressure rectifier; a further condenser for condensing nitrogen-enriched vapor separated in the intermediate pressure rectifier so as to provide reflux for the intermediate pressure rectifier; a first reboiler associated with the intermediate pressure rectifier, said first reboiler having condensing passages in communication with nitrogen separated, in use, in the higher pressure rectifier and thereby being able to function as one of said first condensers; a second reboiler associated with the lower pressure rectifier having condensing passages in communication with the cooling means; and a further rectifier for separating an argon product from a stream of argon-enriched oxygen vapor withdrawn in use from the lower pressure rectifier; wherein the lower pressure rectifier communicates with an outlet for liquid air further enriched in oxygen from the intermediate pressure column.

By the term "rectifier" as used herein is meant a fractionation or rectification column in which, in use, an ascending vapor phase undergoes mass exchange with a descending liquid phase, or a plurality of such columns operating at generally the same pressure.

References herein to "reboiling" a rectifier mean that a liquid feed or liquid taken out of mass exchange relationship with ascending vapor in a rectifier is boiled at least in part so as to create an upward flow of vapor through the rectifier. The boiling is typically performed by indirect heat exchange with condensing vapor in a condenser-reboiler. The condenser-reboiler may be located within or outside the rectifier.

Air is condensed as a result of the reboiling of the lower pressure rectifier. A part or all of the air stream used to reboil the lower pressure rectifier may be so condensed. If all of the air stream is so condensed, there is a separate feed of vaporous air to the higher pressure rectifier. If the air stream is only partly condensed, it may form the flow to the higher pressure rectifier of compressed and cooled feed air. Alternatively, the liquid and vapor phases may be disengaged from one another with the vapor sent to the higher pressure rectifier and the liquid sent to one or more of the lower pressure rectifier, the higher pressure rectifier, and the intermediate pressure rectifier. Similarly, if all the air stream used to reboil the lower pressure rectifier is condensed, it may be distributed to one or more of the aforesaid rectifiers.

A part of the nitrogen separated in the higher pressure rectifier is preferably condensed by indirect heat exchange in a condenser-reboiler with liquid taken from an intermediate mass exchange region of the lower pressure rectifier. As a result of this heat exchange, at least part of the liquid is reboiled. The resulting vapor is preferably returned to a mass exchange region of the lower pressure rectifier.

Preferably, a stream of liquid air further enriched in oxygen is withdrawn from the intermediate pressure rectifier, is passed through a throttling valve or otherwise reduced in pressure, and is indirectly heat exchanged with a stream of the nitrogen-enriched fluid separated in the intermediate pressure rectifier so as to effect the condensation of the nitrogen. As a result, at least part of the pressure-reduced liquid is reboiled. Downstream of the heat exchange with the nitrogen-enriched fluid, the stream of at least partially reboiled further-enriched liquid is preferably introduced into the lower pressure rectifier for separation. The nitrogen-enriched vapor is preferably nitrogen of essentially the same purity as that separated in the higher pressure rectifier. Typically, the nitrogen-enriched vapor can be condensed at a rate in excess of that required to provide the necessary reflux for the intermediate pressure rectifier. The excess condensate may be used as reflux in one or both of the higher and lower pressure rectifiers and/or may be taken as product.

The method and apparatus according to the invention may be employed to produce an impure oxygen product typically containing from 93 to 97% by volume of oxygen. In addition, up to about 40% of the total oxygen product may be produced as a higher purity oxygen product, typically containing about 99.5% by volume of oxygen. The oxygen products are preferably withdrawn from the lower pressure rectifier in liquid state.

The argon-enriched oxygen vapor stream and impure oxygen product are preferably taken from the same region of the lower pressure rectifier, that is to say that there is no liquid-vapor contact means intermediate an outlet from the lower pressure rectifier for the impure oxygen product and an outlet for argon-enriched oxygen vapor feed to the argon rectifier. Preferably some impure oxygen product is also taken from the bottom of the rectifier in which the argon product is produced. If desired, impure oxygen product withdrawn from the lower pressure may be sent first to the argon rectifier, and a single impure product oxygen stream withdrawn from the bottom of the argon rectifier.

By including the intermediate pressure rectifier in the method and apparatus according to the invention, the rate at which liquid nitrogen reflux for the lower pressure and higher pressure rectifiers can be enhanced in comparison with comparable conventional methods in which no such rectifier is used. As a result a greater proportion of the air feed may be condensed while maintaining oxygen recovery. The increased reboil rate thus generated at the bottom of the lower pressure rectifier has the consequence that the proportion of relatively high purity oxygen product may be increased. Alternatively or additionally, significant quantities of a liquid or vaporous nitrogen product may be withdrawn from the lower pressure and/or intermediate pressure rectifiers. If withdrawn in liquid state, the nitrogen product may be pressurized in a pump and vaporized in the main heat exchanger to produce the product at any desired pressure.

BRIEF DESCRIPTION OF THE DRAWING

The method and apparatus according to the invention will now be described by way of example with reference to the accompanying drawing which is a schematic flow diagram of an air separation plant.

The drawing is not to scale.

DETAILED DESCRIPTION

Referring to the drawing, a feed air stream is compressed in a compressor 2 and the resulting compressed feed air stream is passed through a purification unit 4 effective to remove water vapor and carbon dioxide therefrom. The unit 4 employs beds (not shown) of adsorbent to effect this removal of water vapor and carbon dioxide. The beds are operated out of sequence with one another such that while one or more beds are purifying the feed air stream, the remainder are being regenerated, for example by being purged with a stream of hot nitrogen. Such a purification unit and its operation are well known in the art and need not be described further.

The purified feed air stream is divided into three subsidiary air streams. A first subsidiary air stream flows through a main heat exchanger 6 from its warm end 8 to its cold end 10 and is thereby cooled from about ambient temperature to its saturation temperature (or other temperature suitable for its separation by rectification). The thus cooled air stream flows through a condenser-reboiler 12 and is partially condensed therein. The resulting partially condensed air stream is introduced into a higher pressure fractionation column 14 through an inlet 16. An alternative arrangement (which is not shown) is to divide the first subsidiary air stream downstream of the cold end 10 of the main heat exchanger 6 and introduce one part directly into the higher pressure fractionation column 14 and to condense entirely the other part in the condenser-reboiler 12 upstream of its introduction into the column 14.

In addition to the feed through the inlet 16, the higher pressure fractionation column is also fed with a liquid air stream. To this end, a second subsidiary stream of purified air is further compressed in a compressor 18 and cooled to its saturation temperature by passage through the main heat exchanger 6 from its warm end 8 to its cold end 10. The thus cooled second subsidiary air stream is divided into three parts. One part flows through a throttling valve 20 and is introduced into the higher pressure fractionation column 14 through an inlet 22. The use to which the other parts of the cooled second subsidiary air stream is put will be described below.

The higher pressure fractionation column 14 contains liquid-vapor contact means (not shown) whereby a descending liquid phase is brought into intimate contact with an ascending vapor phase such that mass transfer between two phases takes place. The descending liquid phase becomes progressively richer in oxygen and the ascending vapor phase progressively richer in nitrogen. The liquid-vapor contact means may comprise an arrangement of liquid-vapor contact trays or may comprise structured or random packing.

Liquid collects at the bottom of the higher pressure fractionation column 14. The inlets 16 and 22 are located such that the liquid so collected is approximately in equilibrium with incoming vaporous air. Accordingly, since oxygen is less volatile than the other main components (nitrogen and argon) of the air, the liquid collecting at the bottom of the column 14 is enriched in oxygen and typically contains in the order of from 30 to 35% by volume of oxygen.

A sufficient number of trays or a sufficient height of packing is included in the higher pressure fractionation column 14 for the vapor produced at the top of the column 14 to be essentially pure nitrogen. The nitrogen is condensed so as to provide a downward flow of liquid nitrogen reflux for the column 14 and also to provide such reflux for a lower pressure rectification column 24 with which boiling passages (not shown) of the first condenser-reboiler 12 are associated. Condensation of the nitrogen is effected in two further condenser-reboiler 26 and 28. The boiling passages (not shown) of the condenser-reboiler 26 are associated with an intermediate mass transfer region of the lower pressure rectification column 24. The boiling passages (not shown) of the condenser-reboiler 28 are associated with the bottom of an intermediate pressure rectification column 30. That part of the nitrogen condensed in the condenser-reboiler 26 which is not required as reflux in the higher pressure rectification column 14, is sub-cooled in a heat exchanger 32, is passed through a throttling valve 34, is introduced through an inlet 36 into the top of the lower pressure rectification column 24, and provides liquid nitrogen reflux for that column.

A stream of oxygen-enriched liquid is withdrawn from the bottom of the higher pressure fractionation column 14 through an outlet 38, is sub-cooled in the heat exchanger 32, is reduced in pressure by passage through a throttling valve 40, and is introduced into the bottom of the intermediate pressure rectification column 30. The intermediate pressure rectification column 30 is also fed with one of the two parts of the cooled second subsidiary air stream that are not sent to the higher pressure fractionation column 14. This part is reduced in pressure by passage through a throttling valve 42 upstream of its introduction in liquid state into the intermediate pressure rectification column 30 through an inlet 44. The intermediate rectification column 30 separates the air into firstly liquid air further enriched in oxygen and secondly nitrogen. The column 30 is provided with liquid-vapor contact means such as trays or structured packing to enable an ascending vapor phase to come into intimate contact with a descending liquid phase, thereby enabling mass transfer to take place between the two phases. The upward flow of vapor is created by boiling the liquid that collects at the bottom of the intermediate rectification column 30. This boiling is carried out in the boiling passages (not shown) of the condenser-reboiler 28, by indirect heat exchange with condensing nitrogen. A sufficient number of trays or a sufficient height of packing is included in the column 30 to ensure that essentially pure nitrogen is produced at its top. A stream of this nitrogen vapor is withdrawn from the top of the intermediate pressure rectification column 30 and is condensed in a condenser 46. One part of the condensate is used as liquid nitrogen reflux in the intermediate pressure rectification column 30. Another part is pressurized by a pump 48 and is passed through the main heat exchanger 6 from its cold end 10 to its warm end 8. The pressurized nitrogen stream is thus vaporized and emerges from the warm end 8 of the main heat exchanger 6 as a high pressure nitrogen product at approximately ambient temperature. A third part of the nitrogen condensed in the condenser 46 is reduced in pressure by passage through a throttling valve 50, and is introduced into the top of the lower pressure rectification column 24 as reflux through an inlet 52. It will be appreciated, therefore, that operation of the intermediate pressure rectification column 30 enhances the rate at which nitrogen separated in the higher pressure fractionation column 14 can be condensed, and enhances the rate at which liquid nitrogen reflux can be provided to the columns 14 and 24.

A stream of liquid air further enriched in oxygen (typically containing about 40% by volume of oxygen) is withdrawn through an outlet 54 from the bottom of the intermediate pressure rectification column 30. The stream is divided into two parts. One part flows through a throttling valve 56 in order to reduce its pressure to a little above that at which the lower pressure rectification column 24 operates. The pressure reduced stream of further enriched liquid air flows through the condenser 46 in indirect heat exchange relationship with condensing nitrogen. Cooling is thus provided for the condenser 46 and the further-enriched liquid air is reboiled by the heat exchange. The resulting vaporized further enriched air stream is introduced through an inlet 58 into the lower pressure rectification column 24 at an intermediate liquid vapor contact region thereof. The other part of the further-enriched liquid air stream that is withdrawn from the bottom of the intermediate pressure rectification column 30 is divided again into two streams. One of these streams is reduced in pressure by passage through a throttling valve 60 and is introduced into the lower pressure rectification column 24 through an inlet 62 at a level above that of the inlet 58. The other stream of further enriched liquid air flows through a throttling valve 64 in order to reduce its pressure. The pressure-reduced further-enriched liquid air stream flows from the valve 64 through a condenser 66 which is associated with the head of an argon rectification column 68 located by the side of and fed from the lower pressure rectification column 24. The stream of further-enriched liquid air flowing through the condenser 66 is reboiled and the resulting vapor is introduced into the lower pressure rectification column -24 through an inlet 70 at the same level as the inlet 58.

Further air feed streams for the lower pressure rectification column 24 are provided. First, the third part of the cooled second subsidiary air stream is taken from downstream of the cold end 10 of the main heat exchanger 6, is sub-cooled by passage through the heat exchanger 32, is passed through a throttling valve 72, and is introduced into the lower pressure rectification column 24 as a liquid stream through an inlet 74 at a level above that of the inlet 62 but below that of the inlets 36 and 52. Second, the third subsidiary purified air stream is employed as a feed to the lower pressure rectification column 24. This stream is further compressed in a compressor 76, cooled to a temperature of about 150K by passage through the main heat exchanger 6 from its warm end 8 to an intermediate region thereof, is withdrawn from the intermediate region of the main heat exchanger 6, is expanded to a pressure a little above that of the lower pressure rectification column 24 in an expansion turbine 78, and is introduced into the column 24 through an inlet 80 at the same level as the inlet 62. Expansion of the third subsidiary air stream in the turbine 78 takes place with the performance of external work which may, for example, be the driving of the compressor 76. Accordingly, if desired, the rotor (not shown) of the turbine 78 may be mounted on the same drive shaft as the rotor (not shown) of the compressor 76. Operation of the turbine 78 generates the necessary refrigeration for the air separation process. The amount of refrigeration required depends on the proportion of the incoming air that is separated into liquid product. In the plant shown in the drawing, only argon is produced in liquid state. Accordingly, only one turbine is required.

The various air streams fed to the lower pressure rectification column 24 are separated therein into oxygen and nitrogen products. In order to effect the separation, liquid-vapor contact means (not shown), for example distillation trays or random or structured packing, are provided in the column 24 to effect intimate contact between ascending vapor and descending liquid therein, thereby enabling mass transfer to take place between the two phases. The downward flow of liquid is created by the introduction of liquid nitrogen reflux into the column 24 through the inlets 52 and 36. Indirect heat exchange of liquid at the bottom of the column 24 with condensing air in the condenser-reboiler 12 provides an upward flow of vapor in the column 24. This upward flow is augmented by operation of the condenser-reboiler 26 which reboils liquid withdrawn from mass exchange relationship with vapor at an intermediate level of the column 24, typically below that of the inlets 58 and 70. An essentially pure nitrogen product is withdrawn from the top of the lower pressure rectification column 24 through an outlet 82, is warmed by passage through the heat exchanger 32 countercurrently to the streams being sub-cooled therein, and is further warmed by passage through the main heat exchanger 6 from its cold end 10 to its warm end 8. A pure nitrogen product at a relatively low pressure is thus able to be produced at approximately ambient temperature.

Two oxygen products are taken from the lower pressure rectification column 24. A relatively pure oxygen product (typically containing 99.5% oxygen) is withdrawn in liquid state through an outlet 84 at the bottom of the column 24 and is pressurized by a pump 86 to a desired elevated supply pressure. The resulting pressurized liquid oxygen stream is vaporized by passage through the heat exchanger 6 from its cold end 10 to its warm end 8. An impure oxygen product (typically containing 95% by volume of oxygen) is withdrawn from an intermediate mass exchange level of the column 24 through an outlet 88 in liquid state and is pressurized to a supply pressure by operation of a pump 90. The resulting impure oxygen product is vaporized by passage through the main heat exchanger 6 from its cold end 10 to its warm end 8. The pressure at which the second subsidiary purified air stream is passed through the main heat exchanger 6 is selected so as to maintain a close match between the temperature-enthalpy profile of this stream and that of the vaporizing liquid oxygen streams.

Although the incoming air contains only about 0.93% by volume of argon, a substantially higher peak argon concentration is created at an intermediate region of the column 24. The column 24 is thus able to act as a source of argon-enriched oxygen for separation in the argon rectification column 68. An argon-enriched oxygen stream in vapor phase is preferably taken from the same region of the low pressure rectification column 24 as the impure oxygen product stream. Accordingly, the argon-enriched oxygen stream contains about 7% by volume of argon. It is withdrawn from the column 24 through an outlet 92 and is introduced into the bottom of the argon rectification column 68. The column 68 contains liquid-vapor contact means (not shown), preferably structured packing, to enable ascending vapor to come into intimate contact with descending liquid. The flow of descending liquid is created by condensation in the condenser 66 of vapor taken from the head of the column 68. A part of the condensate is returned to the column 68 as a reflux stream, while the remainder is taken as liquid argon product through an outlet 94. The purity of the argon product depends on the height of packing in the column 68. If an amount of packing equivalent to about 180 theoretical plates is used, an essentially oxygen-free argon product may be produced. If desired, any residual nitrogen impurity can be removed from the argon product by adsorptive separation or by rectification in a further column (not shown). As an alternative to producing oxygen-free argon in the column 68, a substantially shorter column employing a lower height of packing may be used, and the resulting oxygen-containing argon product may have its oxygen removed by catalytic reaction with hydrogen followed by adsorption of resulting water vapor and separation of nitrogen and hydrogen impurities by rectification.

A stream of liquid is withdrawn from the bottom of the argon rectification column 68 through an outlet 96. Unlike conventional argon production processes, this stream of liquid is not returned to the lower pressure rectification column 24. Rather, it is united with the impure oxygen product withdrawn through the outlet 88 from the lower pressure rectification column 24.

In a typical example of the operation of the plant shown in the drawing, the higher pressure fractionation column 14 operates at a pressure in the range of 3.75 to 4.5 bar at its top; the intermediate pressure rectification column 30 at a pressure in the range of 2.5 to 2.8 bar at its top; the lower pressure rectification column 24 at a pressure of about 1.3 bar at its top; and the argon rectification column 68 at a pressure of about 1.1 bar at its top. The impure and pure oxygen products are typically produced in this example at a pressure of 8 bar and the pressurized nitrogen product at a pressure of 10 bar. Further, in this example, the compressor 18 has an outlet pressure of 22 bar and the compressor 76 outlet pressure of 7.5 bar. By virtue of the operation of the intermediate pressure rectification column 30, it is possible in this example to recover up to 20% of the argon in the incoming air as an argon product and to produce up to 50% of the oxygen product at a purity of 99.5%.

If desired, various changes and modifications may be made to the method and plant shown in the drawing. For example, the partially condensed air stream may downstream of the condenser-reboiler be subjected to phase separation, and the resulting vapor phase introduced into the higher pressure rectifier 14 through the inlet 16. The liquid air so separated may be distributed among the rectifiers 14, 24 and 30.

I claim:

1. A method of separating air comprising:

compressing and cooling feed air; introducing a flow of the feed air at least partly in vapor state into a higher pressure rectifier; separating the flow into oxygen-enriched liquid air and nitrogen; condensing the nitrogen so separated and employing one part of the condensate as reflux in the higher pressure rectifier and another part of it as reflux in a lower pressure rectifier;

separating nitrogen-enriched vapor from a stream of the oxygen-enriched liquid air in an intermediate pressure rectifier; condensing nitrogen-enriched vapor so separated so as to provide reflux for the intermediate pressure rectifier; reboiling the intermediate pressure rectifier with a stream of nitrogen separated in the higher pressure rectifier and thereby condensing the nitrogen stream and meeting part of the requirement for condensation of the nitrogen separated in the higher pressure rectifier; separating in the lower pressure rectifier a stream withdrawn from the intermediate pressure rectifier of liquid air further enriched in oxygen; reboiling the lower pressure rectifier with a vapor stream of the feed air; and withdrawing a stream of argon-enriched oxygen vapor from the lower pressure rectifier and separating it by rectification to produce an argon product.

2. The method as claimed in claim 1, in which both an impure oxygen product containing from 93 to 97% by volume of oxygen and a relatively pure oxygen product are withdrawn from the lower pressure rectifier.

3. The method as claimed in claim 2, in which both the oxygen products are withdrawn in liquid state.

4. The method as claimed in claim 2, in which the impure oxygen product and the argon-enriched oxygen vapor stream are withdrawn from the same region of the lower pressure rectifier.

5. The method as claimed in claim 4, in which some impure oxygen product is also taken from the bottom of the rectifier in which the argon product is produced.

6. The method as claimed in claim 1, in which a part of the nitrogen separated in the higher pressure rectifier is condensed by indirect heat exchange with liquid taken from an intermediate mass exchange region of the lower pressure rectifier, at least part of the liquid is reboiled, and the resulting vapor is returned to a mass exchange region of the lower pressure rectifier.

7. The method as claimed in claim 1, in which a stream of liquid air further enriched in oxygen is withdrawn from the intermediate pressure rectifier, is reduced in pressure, and is indirectly heat exchanged with a stream of the nitrogen-enriched fluid separated in the intermediate pressure rectifier so as to effect the condensation of the nitrogen.

8. The method as claimed in claim 7, in which the pressure-reduced stream of liquid air further enriched in oxygen is at least partially reboiled by its heat exchange with the stream of nitrogen-enriched fluid, and downstream of the heat exchange is introduced into the lower pressure rectifier for separation.

9. The method as claimed in claim 1, in which the said nitrogen-enriched vapor is of essentially the same purity as the nitrogen separated in the higher pressure rectifier.

10. The method as claimed in claim 1, in which the said nitrogen-enriched vapor is condensed at a rate in excess of that required to provide the necessary reflux for the intermediate pressure rectifier, and the excess condensate is used as reflux in one or both of the higher and lower pressure rectifiers and/or is taken as a nitrogen product.

11. An apparatus for separating air comprising: means for compressing feed air and means for cooling the compressed air; a higher pressure rectifier for separating a flow of the feed air at least partly in vapor state into oxygen-enriched liquid air and nitrogen; a plurality of first condensers for condensing nitrogen so separated so as to enable in use part of the condensed nitrogen to pass to the higher pressure rectifier as reflux and another part of it to a lower pressure rectifier also as reflux; an intermediate pressure rectifier for separating nitrogen-enriched fluid from a stream of oxygen-enriched liquid air withdrawn, in use, from the higher pressure rectifier; a further condenser for condensing nitrogen-enriched vapor separated in the intermediate pressure rectifier so as to provide reflux for the intermediate pressure rectifier; a first reboiler associated with the intermediate pressure rectifier; said first reboiler having condensing passages in communication with nitrogen separated, in use, in the higher pressure rectifier and thereby being able to function as one of said first condensers; a second reboiler associated with the lower pressure rectifier having condensing passages in communication with the cooling means; and a further rectifier for separating an argon product from a stream of argon-enriched oxygen vapor withdrawn in use from the lower pressure rectifier; the lower pressure rectifier communicating with an outlet for liquid air further enriched in oxygen from the intermediate pressure column.

12. The apparatus as claimed in claim 11, in which the lower pressure rectifier has one outlet for an impure oxygen product containing from 93 to 97% by volume of oxygen and another outlet for a relatively pure oxygen product.

13. The apparatus as claimed in claim 12, in which both the outlets for the oxygen products are arranged so as to take the respective products in liquid state.

14. The apparatus as claimed in claim 12, in which there is no liquid-vapor contact means in the lower pressure rectifier intermediate the outlet for impure oxygen therefrom and the outlet for the argon-enriched oxygen vapor feed to the argon rectifier.

15. The apparatus as claimed in claim 11, in which there is an outlet for impure oxygen product from the bottom of the argon rectifier.

16. The apparatus as claimed in claim 11, in which another of the first condensers includes reboiling passages having their inlets in communication with an intermediate mass transfer region of the lower pressure rectifier.

17. The apparatus as claimed in claim 11, in which the further condenser includes reboiling passages having inlet ends in communication via a throttling valve with an outlet for liquid air further enriched in oxygen from the intermediate pressure rectifier.

18. The apparatus as claimed in claim 11, wherein the further condenser has condensing passages with outlets in communication with one or both of the higher and lower pressure rectifiers.

* * * * *